US005950376A

United States Patent [19]

Kemeny et al.

[11] Patent Number: 5,950,376

[45] Date of Patent: Sep. 14, 1999

[54] FIREPROOFING

[75] Inventors: Zoltan A. Kemeny, La Tempe; J. Paul Attaway, Paradise Valley, both of Ariz.; C. Michael Schuerman, Gwinnett County; Julian J. Attaway, Sea Island, both of Ga.

[73] Assignee: MM Systems Corporation, Tucker, Ga.

[21] Appl. No.: 08/865,396

[22] Filed: May 28, 1997

Related U.S. Application Data

[63] Continuation of application No. 08/375,110, Jan. 19, 1995, abandoned, which is a continuation of application No. 08/283,764, Aug. 1, 1994, abandoned.

[51] Int. Cl.[6] ..... E04B 1/94; E04B 1/98

[52] U.S. Cl. ..... 52/167.1; 52/232; 52/481.1; 52/573.1; 52/741.3

[58] Field of Search ..... 52/1, 19, 20, 21, 52/167.1, 167.3, 169.6, 232, 236.3, 262, 265, 317, 481.1, 573.1, 721.4, 721.5, 723.1, 723.2, 736.3, 736.4, 737.5, 738.1, 787.11, 793.11, 741.3

[56] References Cited

U.S. PATENT DOCUMENTS

| | | | |
|---|---|---|---|
| 3,641,724 | 2/1972 | Palmer | 52/793.11 |
| 4,529,467 | 7/1985 | Ward et al. | 52/232 X |
| 4,546,584 | 10/1985 | Mieyal et al. | 52/481.1 X |
| 4,628,651 | 12/1986 | Morettin et al. | 52/481.1 X |

FOREIGN PATENT DOCUMENTS

| | | | |
|---|---|---|---|
| 2480331 | 10/1981 | France | 52/232 |
| 3-25134 | 2/1991 | Japan | 52/232 |

*Primary Examiner*—Carl D. Friedman
*Assistant Examiner*—Kevin D. Wilkens
*Attorney, Agent, or Firm*—Snell & Wilmer L.L.P.

[57] ABSTRACT

A fire proofing assembly with friction sliding surfaces to accommodate wide horizontal seismic isolator movements placed around seismic isolators and in partitions at the perimeter of isolation spaces. Heat reflecting, insulating and intumescent layers may be interposed at friction surfaces. Normal force to friction may be maintained by spring. Temporary, partial dissembling arrangement provided for isolation bearing inspection. Elastomeric curtain may be provided for fire hose test.

15 Claims, 10 Drawing Sheets

FIREPROOFING

This is a continuation application of Kemeny et al., U.S. application Ser. No. 08/283,764 of the same title filed Aug. 1, 1994, now abandoned, and of Kemeny et al., U.S. application Ser. No. 08/375,110 of the same title filed Jan. 19, 1995, now abandoned.

FIELD OF THE INVENTION

This invention relates, generally, to fire proofing assemblies for seismic isolators, including isolation bearings and isolation spaces separated by partitions in buildings, and more particularly specifically to assemblies with wide horizontal and small vertical displacement capacity, with capacity to accommodate thermal expansion movement of buildings, and to resist fire hose test after the outbreak of fire.

BACKGROUND OF THE INVENTION

It is common to protect structures from fire for safety. In seismically isolated buildings the isolators are often an integral part of the structure. Thus, the isolators are to be protected from fire too. By nature of the isolation, an isolation space, usually the basement, moves along with the isolators. The isolation space needs fire proof partitions. These partitions separate the isolation space from the rest of the building as area separation walls. These partitions also need fire proofing, without restraining isolator movement. The isolators have wide horizontal and small vertical movements during earthquakes. Other times they have small horizontal displacements due to thermal expansion of the building. The fire rating assemblies at the isolation space need to accommodate all these movements. Such assemblies are advantageous around the isolators and around the isolation space itself. The isolation space is often closed by partitions. Furthermore, after a fire these are advantageously configured to pass the fire hose test; i.e. the high-pressure cold water right on or after fire. Inadequate assemblies may explode under such a severe test, which recently became a building code requirement in some jurisdictions. Similarly, the fire rating of seismic isolators, such as rubber bearings, is a new code requirement.

Recent efforts to fire rate isolators in the same manner as structures with sprayed asbestos have failed. Accommodation of wide isolator movements was not achievable this way. As long as isolators were placed in a crawling space right above the foundation, the isolation space did not need partitions. A sub floor, usually of concrete did the job. Recently, mostly in seismically retrofitted buildings, the isolators are placed over head in the basement. So partitions are needed to separate isolation and other usable spaces. A current solution to the problem is improvised on the field by contractors. The need for engineered, prefabricated assemblies is manifest.

Several fire rated wall and pipe penetration assemblies are known today. No such assemblies solve all the described problems altogether. Thus a reference could not be cited. The problem is the problem of a niche market.

Fortunately, building codes consider negligible the chance of a fire and concurrent earthquake. However, fire is assumed right after earthquakes due to broken gas pipes. Thus the assembly is desirably fire tested slightly offset, due to permanent isolator displacement. Wide offset fire testing is not required. It is assumed that the isolator movement due to earthquake is only seconds or minutes. The isolator movements are generally cyclic and therefore if during that cycling, fire would penetrate for only a second, that would not harm rubber isolators. Rubber isolators have a ½ inch cover layer to burn or deteriorate otherwise, before vital isolator parts would be harmed. Other isolators are mainly of steel construction and are even less sensitive to fire. Yet the toughest requirement remains: namely to allow for small, about ⅛ inch uplift, while some elastic means would compress the separation surfaces; but not too much, because that may destroy the edges of the retracted surfaces. At a retracted surface, usually one of the mating faces is covered with intumescent material, which expands upon flame contact. That expansion is needed to fill the unevenness of the gap for smoke and flame closure. The backing material of the intumescent advantageously comprises a compressible heat insulator, which is usually some type of ceramic fibre cloth. However, the heat insulator can not be compressed too much because it would loose insulation capacity very fast. Additionally, it would not retract fully or fast enough as the seismic isolator demands. The time mismatch is great. The isolator may also move with 2 to 3 seconds per cycle; and the insulator can recover about 80% compression strain in about 24 hours.

SUMMARY OF THE INVENTION

The invention calls for a spring loaded assembly, not used before in similar applications In accordance with one aspect of the present invention, the assembly is preferably prefabricable; or at least preassembled in spliceable segments.

Moreover, the subject assembly desirably provides for visual inspection of the seismic isolators once in a while. Usually, such inspection is needed after each earthquake. The inspector looks for small surface cracks on a black rubber surface, more specifically on the order of 0.08 inch long, wide and deep. Some isolators are compact and closed, allowing only for peepholes for fiber optic access. This inspection is cumbersome and unreliable. The ideal solution would be removing all obstructions, such as fire rated covers, entirely and then to put them back again. Thus, the present invention suitably calls for light fire rating assemblies bolted together from panels. But at least in part, they should be able to be removed temporarily without heavy lifting devices.

It is therefore one aspect of this invention to provide a fire rated assembly for isolation bearings and isolation spaces accommodating wide isolator movements.

Other aspects are to provide a fire rating assembly with the capacity:

- to fire rate with small, permanent, horizontal displacement; and with small temporary uplift;
- also, to accommodate small vertical compression with short term displacement restoring;
- to provide means for smoke and flame closure upon flame contact;
- to avoid edge failure upon return from full opening;
- to avoid excessive compaction of soft fire rating material;
- to provide for passing water hose test upon fire;
- to be preassembled; or
- prefabricated; and finally to be removable in part for bearing inspection.

The invention achieves its objects by fire rated metal stud wall assemblies; in horizontal or vertical position; independently bolted to the structure under and above the seismic isolators; sliding on each other on interpositioned soft heat insulator and intumescent layers; which may be precompressed slightly by spring loading; and finally, outfitted with an elastomeric sagging curtain, bridging over the isolation space in a position to drop water.

The assembly allows for under-floor or over-footing retrofitting seismic isolator insertion. The isolator protecting assembly is bolted to the structure by angle plates with slotted holes. This connection is removable with relative easiness.

The assembly above the isolators may be in a horizontal position, and is suitably wide enough to accommodate the wide horizontal isolator movements each horizontal way. Around a column containing isolators it looks like a collar. The underside of the collar is coated with a fire blanket and/or intumescent material, which itself is coated by heat reflective, metallic foil. That foil is in friction with the similar or identical blanket-intumescent sub-assembly. The fire blanket is of ceramic fibre with mostly entrapped air. The blanket is coated by flexible heat reflective layer(s).

The assembly under the isolators has a horizontal part, similar to the top assembly, and has vertical walls all around to close like a box.

Either the top or the bottom half assembly is removable by loosening bolts to the structure. After such removal, the bearing can be inspected. The half assembly to remove is light and movable by hand. The stationary part may be heavier. The light assembly is comprised of gypsum board on metal studs or similar. The heavy assembly is comprised of cement or asbestos board on metal framing. Wire mesh with sprayed asbestos or plaster may be used when not planned to remove. Corners of the metal framing may be reinforced with diagonal brace or gusset plate. Such stiffeners shall not interfere with isolator movements. Assembly is right over the foundation so there is no need for a bottom flat part. The walls of the box then are simply bolted down to the foundation.

Isolation space protecting wall assemblies are similar. The fire rated partition is built up by the contractor in two parts. The top part is hung from the ceiling and the bottom part stands on the floor. A horizontal gap is left open at the isolator height. This gap receives the preassembled fire rating parts which is bolted to the walls under and above. Metal cover plates provide for heat reflection, continuity and for aesthetics. The spring is inserted into guided metal channel pairs and heat insulated by fibrous ceramic. The intumescent layer is stapled or glued to the backing material or layer. A metal profile hold down is optional for perforated cover plated intumescent layers.

BRIEF DESCRIPTION OF THE DRAWINGS

Preferred exemplary embodiments of the present invention will hereinafter be described in conjunction with the appended drawing figures, wherein like numerals denote like elements and.

DETAILED DESCRIPTION OF THE PREFERRED EXEMPLARY EMBODIMENTS

Figure 1:
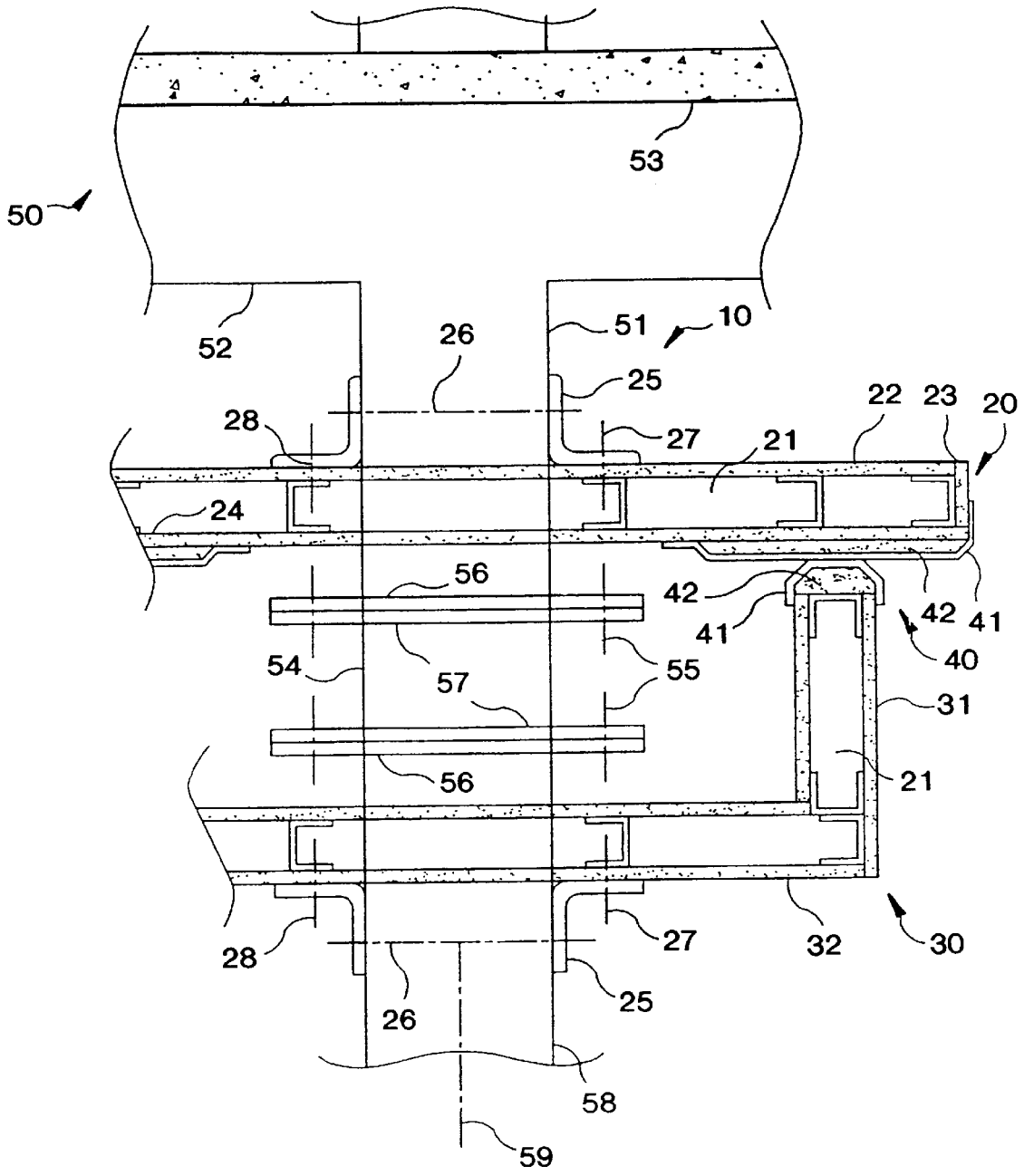
FIG. 1 illustrates an under-floor seismic isolator fire rating assembly.

FIG. 1 illustrates a first exemplary embodiment of a displaceable fire proofing assembly (10) for seismic isolation bearings (54). Bearing (54) may be inserted in to the structure (50) after years of service (retrofit case). The reinforced concrete column marked by centerline of symmetry (59) was saw cut under the floor (53) supported by beams (52). Isolator (54) was inserted by load plate pairs (56 and 57) between the top (51) and the bottom (58) column parts. Flat jack left in the structure permanently transferred the load to the isolator (not shown). The isolator's lateral movement (deformation) is of the order of its height. Clearance is provided in the fire rating assemblies accordingly. The isolators may not self-center completely after earthquake(s). Initial assembly position is consequently somewhat offset. That offset is not shown in figures for clarity. (Fire rating testing is done in about 1 inch offset position.)

A top (20) and a bottom (30) fire rating assembly is bolted to column parts (51 and 58) respectively. Assembly (20) is left to slide on assembly (30). The sliding is helped by sub-assembly (40). Assembly (20), the collar, can be raised by loosening bolt (26). Assembly (30), the box, can be lowered similarly. Raised or lowered half assemblies allow for visual bearing inspection. After inspection the moved assembly(s) are to be bolted back. (Moved assembly position is not shown for clarity.) Bolting is to be through gripping angle plates (25). Angle plate pairs (25) are through bolted to each other by threaded rods or bolts (26). Bolts (27) in slotted holes (28) hold the assemblies to angle plates (25). The slotted holes accommodate gripping movements. After gripping, bolts (27) are tightened in assemblies (20) and/or (30).

The collar assembly (20) is preassembled in panels of metal studs (21) with gypsum board top, side and bottom coverings (22, 23 and 24 respectively).

The box assembly (30) is preassembled similarly with gypsum or cement board coverings on sides (31) and bottoms (32) on framings (21).

The friction sliding sub-assembly (40) consists of an Intumescent layer (41) backed by a compressible fibrous ceramic heat insulator blanket (42). Collar (20) sags over box (30) providing contact at friction sliding. When sub-assembly (40) is not spring loaded, collar (20) is to be flexible enough to provide for spring action.

Figure 2:
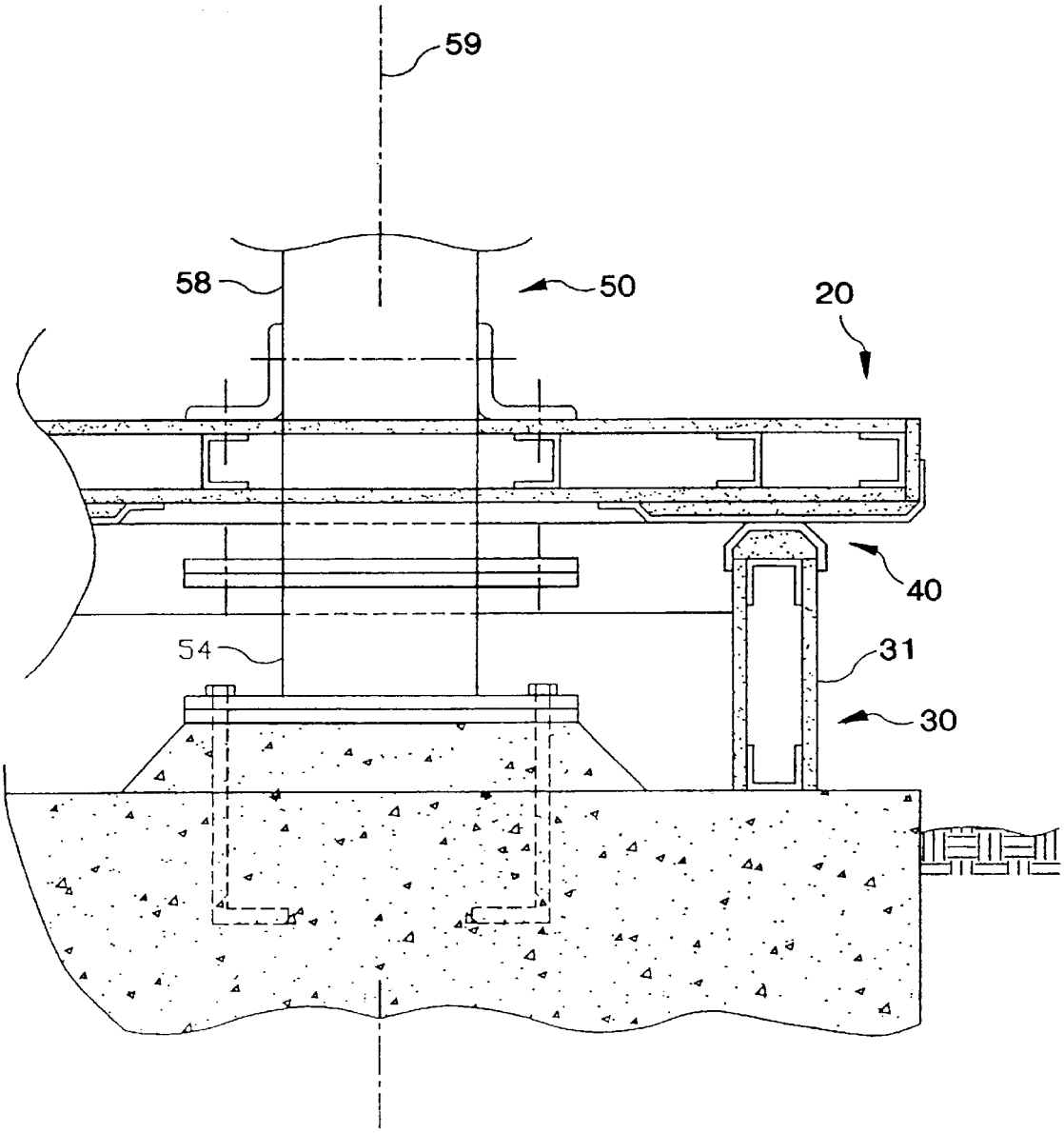
FIG. 2 illustrates an over-footing assembly.

FIG. 2 illustrates a similar assembly to that of FIG. 1, except that it is configured to over-footing isolation bearings. The assembly is symmetrical about line (59). Column (50) with its bottom part (58) rests on isolator (54). Collar (20) is fixed to column part (58). Box (30) has only side walls covered by gypsum boards (31). Sliding sub-assembly (40) separates collar (20) and box (30). The isolator and the box are simply anchor bolted down to the footing.

Figure 3:
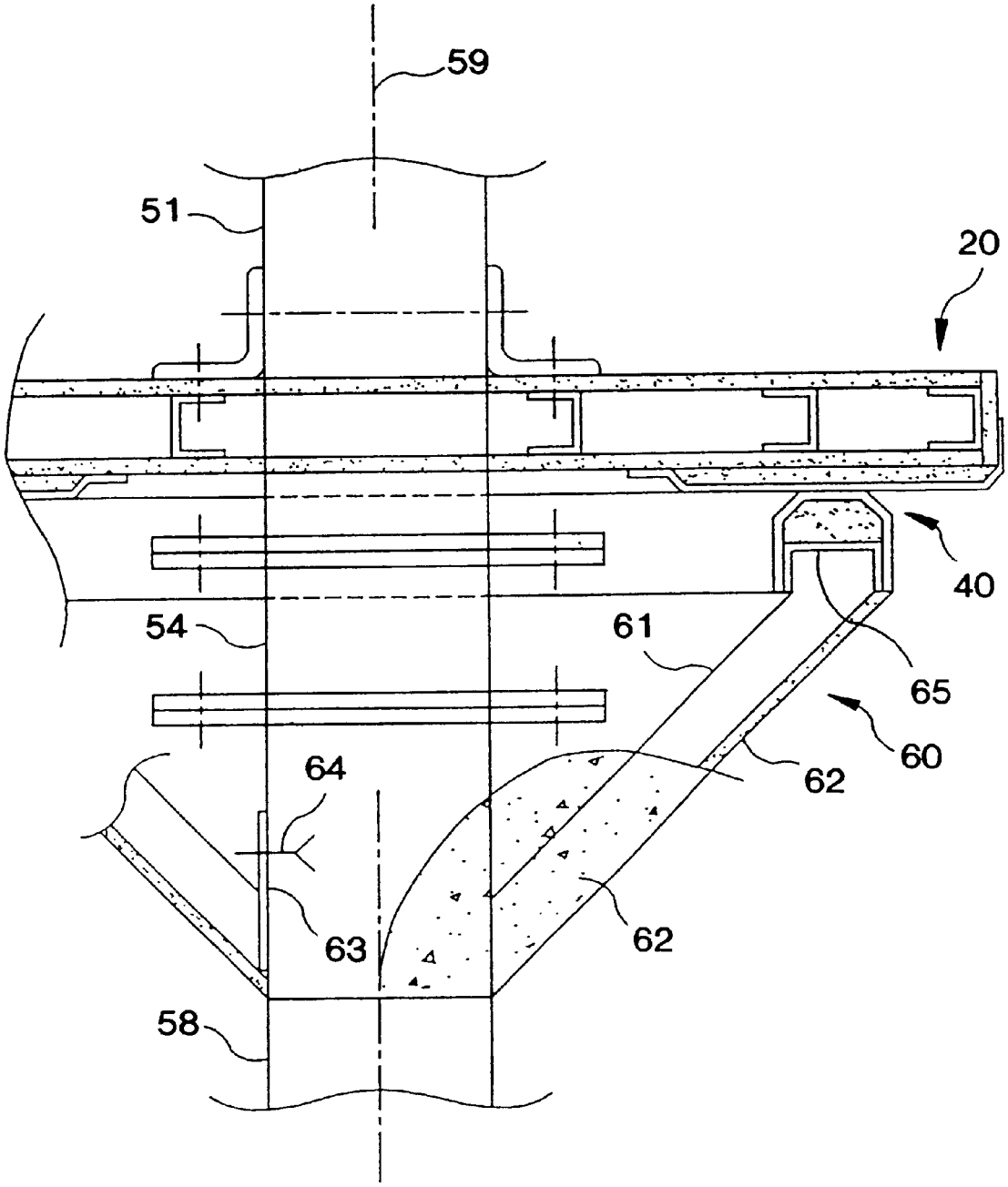
FIG. 3 illustrates the same as FIG. 1 with a fixed prismatic under-box of wire mesh having sprayed-on fire rating.

FIG. 3 illustrates an assembly similar to that of FIG. 1 except that under collar (20) a fix prismatic box (60) is built. Box (60) is built with steel framing (61) and wire mesh with sprayed on asbestos or plaster shell (62). Shell (62) resembles [to] a column capital that is an exposed architectural element. Frame (61) is fixed to column part (58) by connector plate (63) and anchor bolt (64). Bearing (54) is inserted between column parts (51 and 58). The assembly is symmetrical about line (59).

Figure 4:
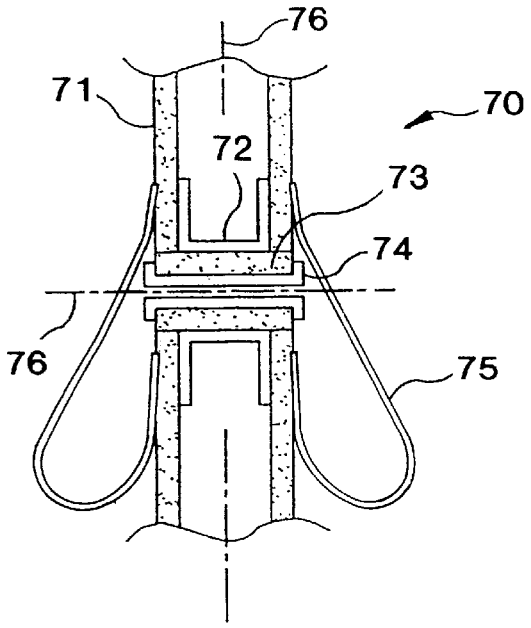
FIG. 4 illustrates a section of a partition fire rating with curtains for fire hose test.

FIG. 4 illustrates a section of a fire rated displaceable partition wall assembly (70). It provides fire rating for seismic isolation spaces. Such space includes everything between the structure above and under seismic isolators and are usually basements. The assembly is double symmetrical abut lines (76). The top part is designed to laterally displace over the bottom part more than the wall thickness itself. The wall is metal stud (72) framed and covered with gypsum boards (71). The friction surface is lined with intumescent (74) backed by compressible heat insulator blanket (73). Blanket (73) is wrapped in heat reflective cloth. For fire hose test, elastomeric curtain (75) is added on both side of the wall. Curtain (75) is painted with heat reflective, fire extinguishing paint. The symmetrical curtain arrangement is provided only when the flame side is unknown. Curtain (75) may burn out at the flame side. The fire hose test is always done on the opposite side.

Figure 5:
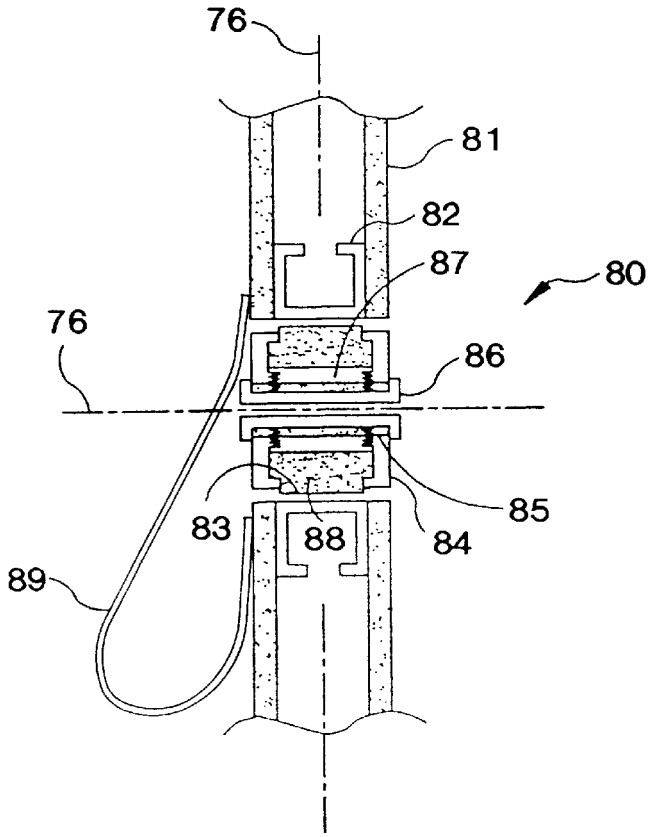
FIG. 5 illustrates a section of the same with spring loaded channels.

FIG. 5 illustrates a similar assembly (80) to that of FIG. 4, except that it is spring loaded and has a single side curtain (89). Assembly (80) is symmetrical about lines (76). The contractor builds partitions of metal studs (82) covered with gypsum boards (81). Assembly (80) comprises interlocking metal channels (83 and 84) which are separated by springs (85). At friction the mating surfaces are lined with intumescent (86). Channel (84) is lined with fire blanket (87) and channel (83) by blanket (88).

Figure 6A:
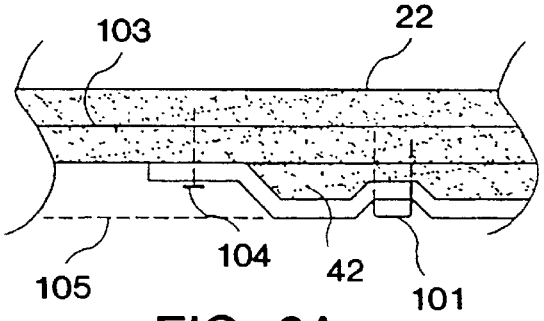
FIGS. 6A and 6B illustrate a partial section of a collar underside with fire rating treatment.
Figure 6B:
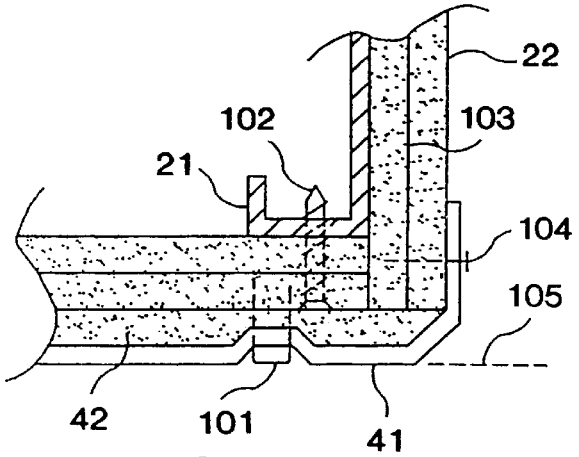

FIGS. 6A and 6B illustrate a partial section of a collar at the friction surface (105). Collar is framed (21) and sided (22). Siding (22) is doubled (103). Intumescent (42) is lined with a heat reflective layer (41). Intumescent (42) is nailed (104) and/or stapled (101) into board (22). Board (22) is screwed to frame (21). Gluing (not shown) is optional to nailing and stapling.

Figure 7:
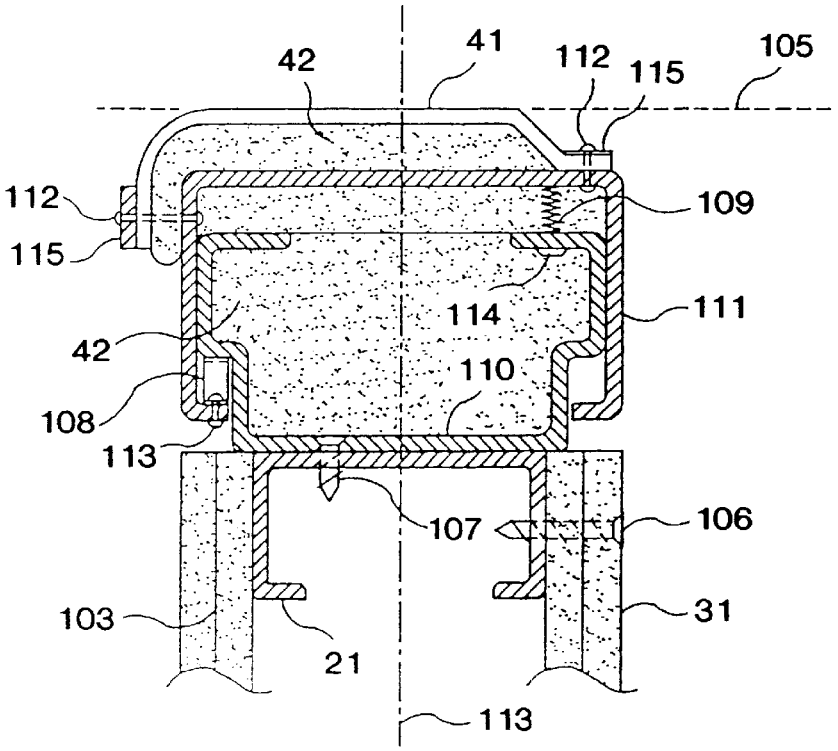
FIG. 7 illustrates a section of the box top with fire rating treatment.

FIG. 7 illustrates a partial section of the box top at friction surface (105). A spring loaded insertable, fire rating subassembly caps the box. Leaf spring (108) or coil spring (109) presses up intumescent (42) lined with heat reflector (41). At subassembly insertion the springs are slightly precompressed. Liner (41) is held down by rivets (112) through washer or strips (115). Leaf spring (108) is riveted down. Coil spring (109) sits in punched seat (114). Springs (108 or 109) press on interlocking channels (110 and 111). Channel (110) is filled with heat insulator blanket (42) lined with intumescent (41). The box is framed by metal stud (21), covered by gypsum boards (31) doubled (103) and screwed (106). Screw (107) connects the sub-assembly to the wall, which is symmetrical about line (113).

Figure 8:
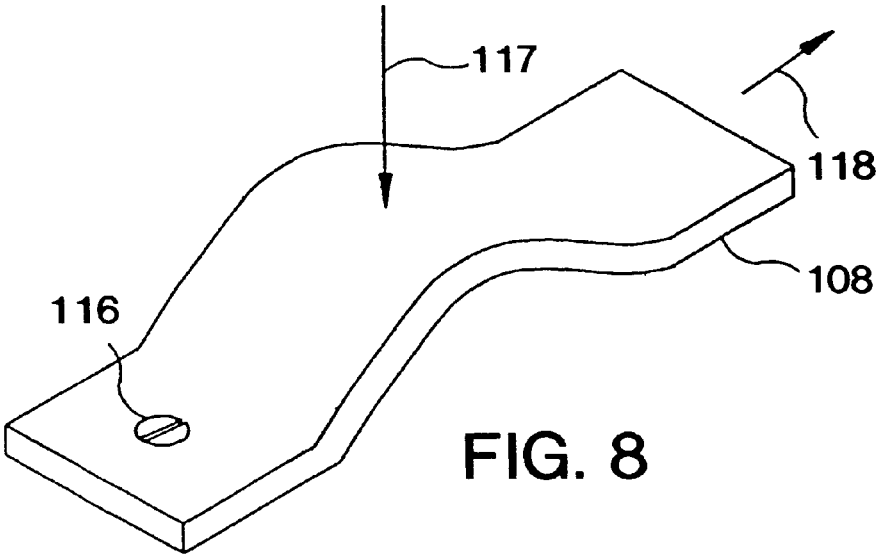
FIG. 8 illustrates a leaf spring mechanism.

FIG. 8 illustrates a leaf spring (108) screwed down (116) at one end only. Upon applied pressure (117) spring (108) is free to extend in direction (118). Optionally the lateral movement can be guided in long slotted hole by a screw (not shown).

Figure 9:
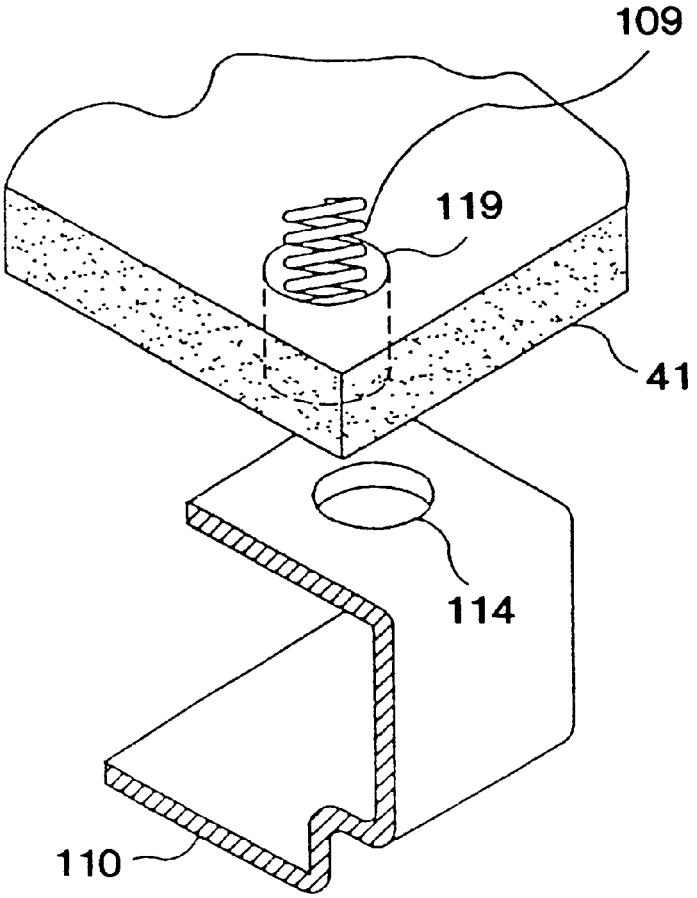
FIG. 9 illustrates a coil spring sub-assembly.

FIG. 9 illustrates a coil spring (109) in punched hole seat (119) in intumescent (41). Spring (109) is seated in deformed seat (114) in channel (110).

Figure 10:
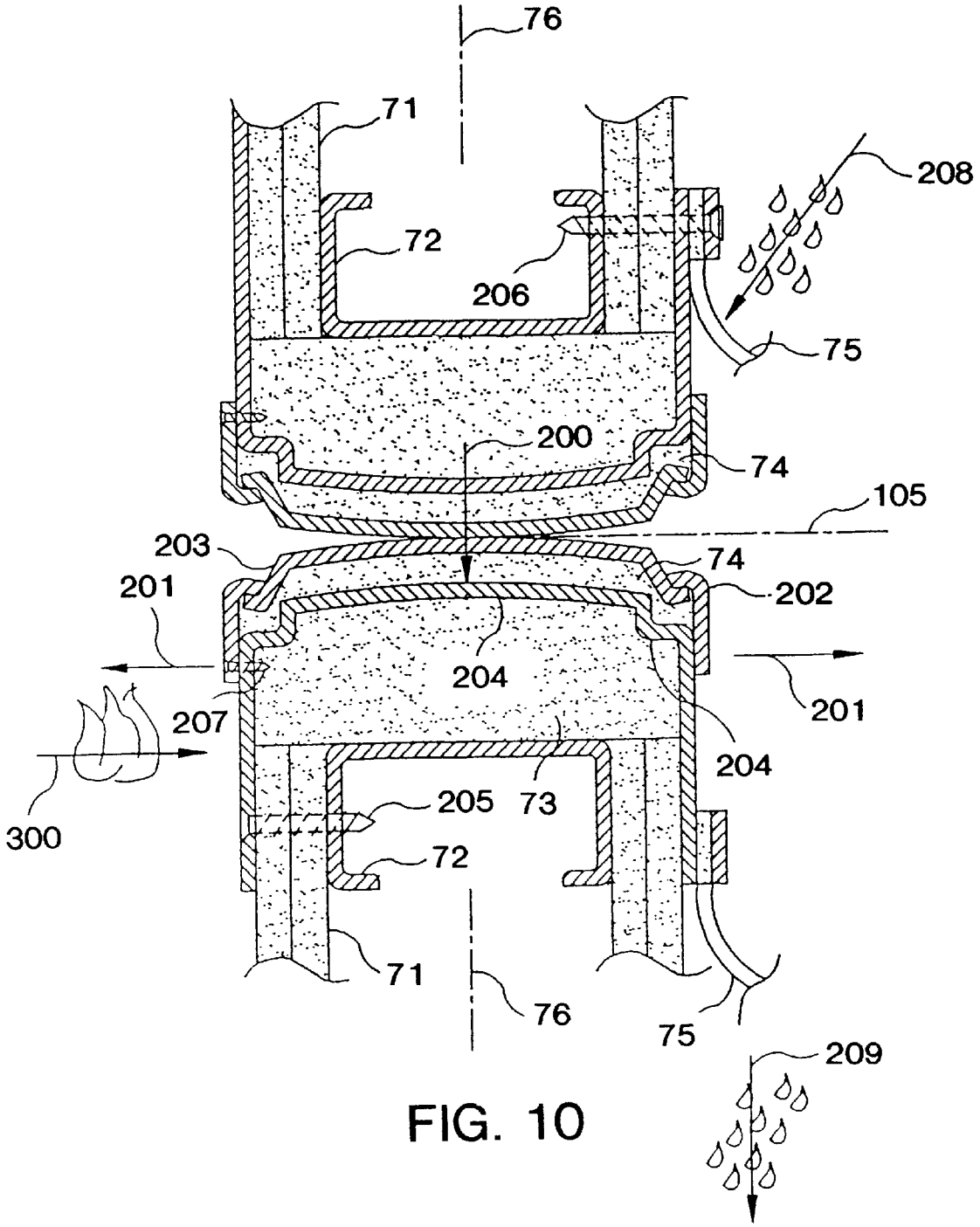
FIG. 10 illustrates a partition fire rating assembly with spring channel mechanisms with flame and hose side indicated.

FIG. 10 illustrates a partition fire rating assembly at friction surface (105) with single symmetry line (76). Flame side (300) is indicated. The opposite side is the water side. Water comes from fire hose from above (208) and drops down (209). Elastomeric curtain (75) prevent cold water penetration into fire rated assembly. That prevents explosion of high heat assembly. Curtain (75) is sized to allow for wide assembly displacement. Curtain (75) is screwed (206) to stud (72).

The assembly may be prefabricated and may be preassembled. The spring is substituted by channel (204) which acts like a spring. Channel (204) is fixed only at the bottom by screws (205). Under pressure (200), channel (204) extends elastically in direction (201). Channel (204) is backed by fire blanket (73) lined with intumescent (74). Intumescent (74) is lined with heat reflector cloth (203) clamped down by profile (202). Profile (202) is screwed (207) to channel (204). The top part is similar to the bottom part. Both parts are of stud (72) gypsum board (71) construction.

Figure 11:
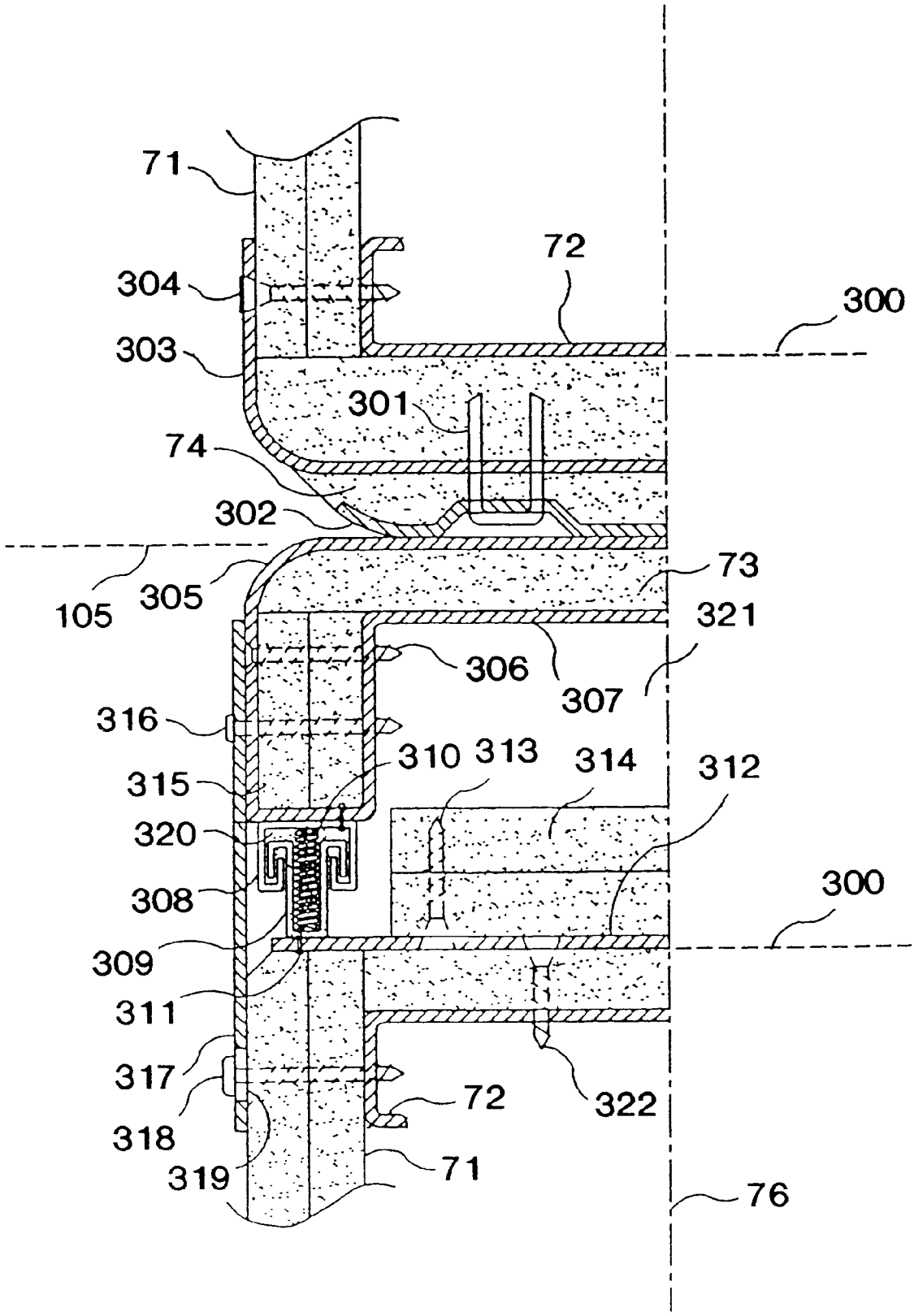
FIG. 11 illustrates a coil spring loaded prefabricated assembly.

FIG. 11 illustrates a coil spring (310) loaded half assembly, symmetrical about line (76). The assembly may be preassembled and/or prefabricated. The receiving partition is horizontally-slotted between lines (300). Partitions are framed (72) with gypsum board sidings (71).

The top part, above friction plane (105) is lined with a fire blanket (302); lined with heat reflective cloth (303) attached (304) to stud (72). Intumescent (74) lined with heat reflective metal layer is stapled into the fire blanket. Under plane (105) blanket (73) is covered by cloth (305) attached by screws (306). Channel (307) backs blanket (73) and holds gypsum board sidings (315).

The bottom of the assembly is mounted on plate (312) which is backed by gypsum boards (314) screwed to plate (312) by screws (313). Channel (72) is recessed in gypsum board sidings (71) and filled with gypsum board screwed (322) to stud (72). Air pocket (321) is formed between channel (307) and board (314). Channel (307) and plate (312) are pushed apart by an independent spring loaded assembly riveted (311) to said channel and plate. Interlocking channels (308 and 309) inhouse spring (310) and blanket (320). At assembly, insertion spring (310) is slightly precompressed. The precompressed bottom assembly is held down by cover plate (317) and screws (316); also by bolts (318), which is in slotted holes (319) to allow for vertical movements.

Figure 12:
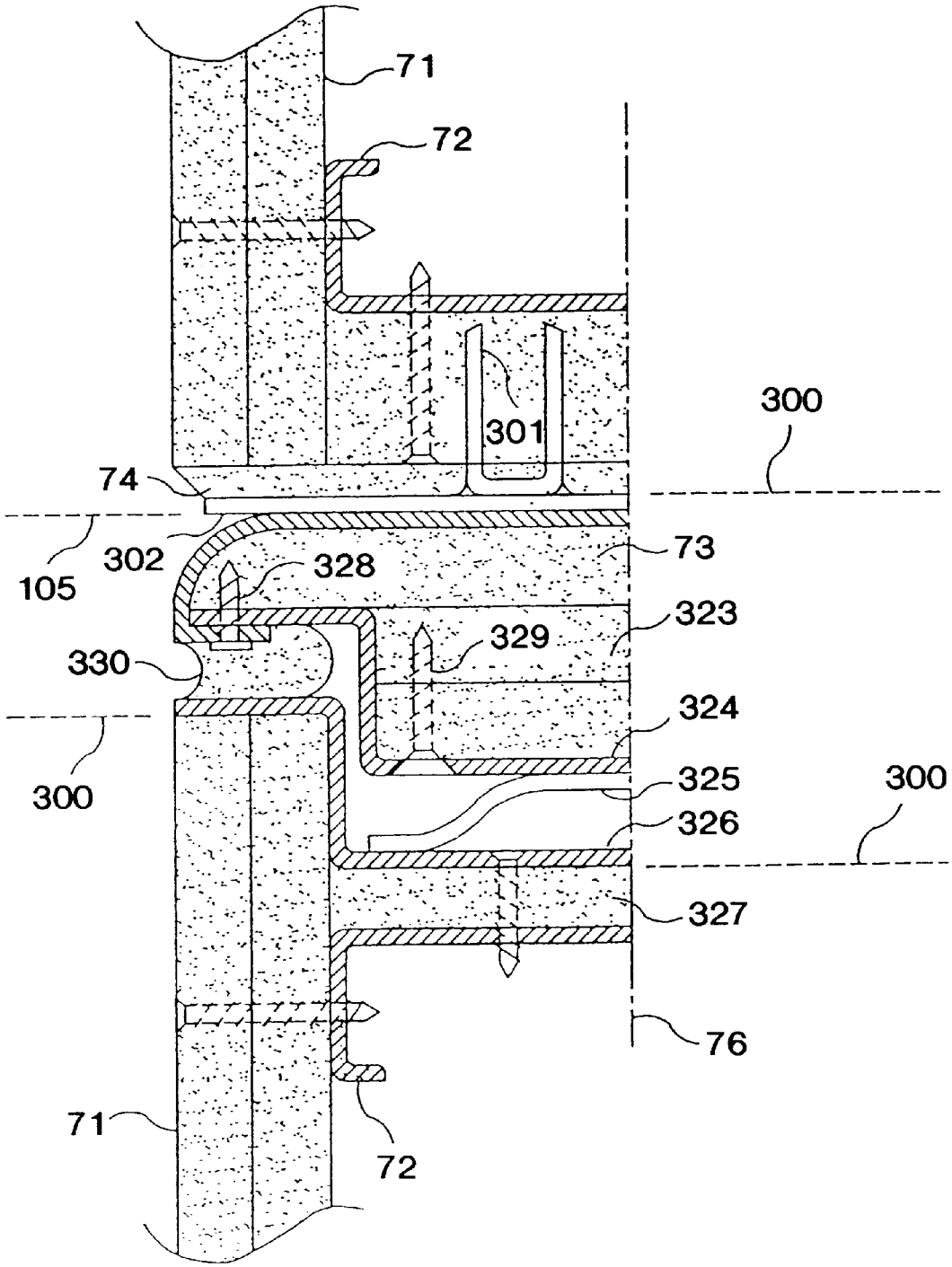
FIG. 12 illustrates a leaf spring loaded field erection assembly.

FIG. 12 illustrates a leaf spring (325) loaded field erection type assembly symmetrical about line (76). The assembly is received between lines (300) in framed (72), boarded (71) partition.

The top part above friction line (105) is of gypsum board lined with intumescent (74) lined with metal foil (302) stapled (301) to the gypsum board.

The bottom part is preassembled in part and prefabricated. Stud (72) is recessed in boards (71) to receive channel (326). Spring (325) lifts up channel (324). Channel (324) slides guided in channel (326). Channels (326 and 324) are sealed at exposed edges by intumescent caulking (330). Channel (324) is filled with gypsum boards (323) attached by screws (329). Board (323) is lined with fire blanket (73) lined with refractory cloth (305) screwed (328) to channel (324).

Figure 13:
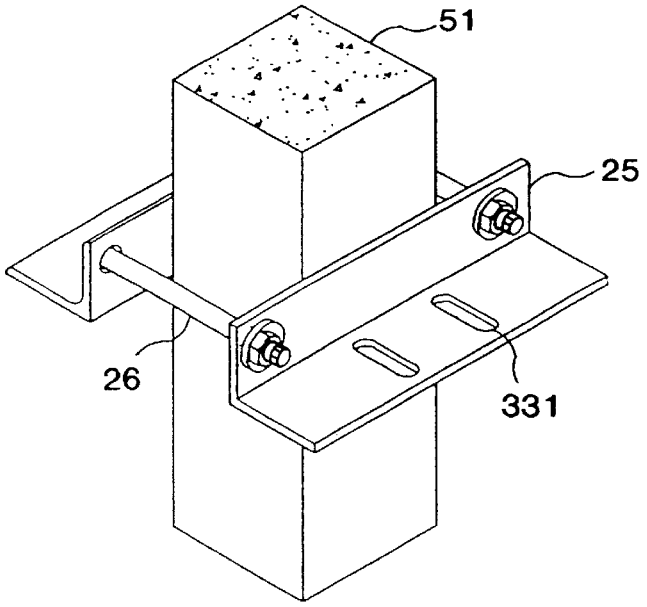
FIG. 13 illustrates an angle plate structural connector subassembly.

FIG. 13 illustrates an angle plate (25) structural connector sub-assembly. Angle plate (25) is pressed by bolts (26) to column (51) and has slotted holes (331) to receive a fire rating assembly.

Figure 14A:
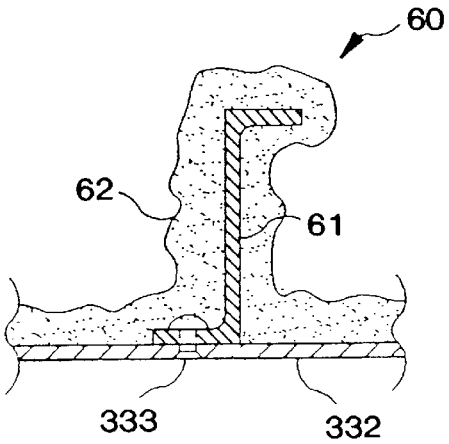
FIG. 14*a* illustrates a detail of a stiffened steel plate collar.

FIG. 14*a* illustrates a metal plate collar assembly (60) with plate (332). Plate (332) is bolted or riveted or welded (333) to stiffener channel (61). The assembly is protected by sprayed on asbestos (62) from above. The under side is the friction surface. Plate (332) is stainless.

Figure 14B:
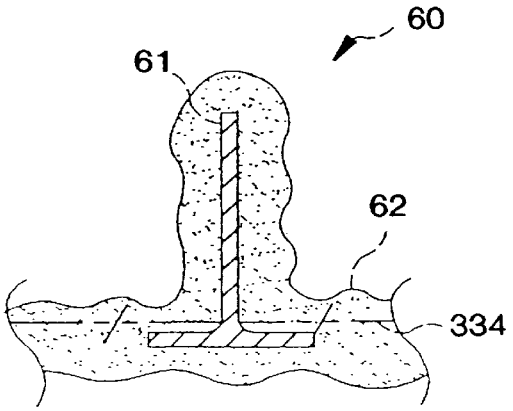
FIG. 14*b* illustrates a detail of a wire mesh box.

FIG. 14*b* illustrates a detail of a wire mesh box with mesh (334). Mesh (334) is supported by framing (61). The sub-assembly (60) is coated by sprayed on asbestos (62).

Some of the displaceable fire proofing assembly's operation and advantages are as follows:

The top part of the assembly may be attached to the structure or partition moving with the structure above the seismic isolators.

The bottom part may be attached similarly to the structure or partition under the isolators.

The top and bottom assembly part can friction-slide while the isolators laterally move. The small frictional force is maintained by spring loading with the help of compressible fire blankets. The spring helps the assembly accommodating small vertical movements as well. Further help comes from an intumescent layer covered by heat reflective metallic foil which is acting at the friction interface. The intumescent expands upon flame contact. The intumescent is stapled or glued to the fire blanket or to the gypsum board linings. The fire blanket is a light weight ceramic fiber covered in flexible heat reflecting cloth. The cloth is glass fiber woven fabric with sprayed on metallic impregnation. The springs are retained in metal channels which are interlocking or guided. Slotted hole screw or bolt connections help spring extension.

The isolator fire proofing assemblies are metal framed fire rated assemblies with gypsum or cement board or sprayed on asbestos cover. Sprayed on cover may be backed by wire mesh. One or both part (top or bottom) of the assembly is light and fixed only with temporary bolting to the structure. That bolting can be easily removed with one of the sub-assemblies to inspect the isolation bearing as needed. After inspection it is to be bolted back.

The assemblies accommodate the most common seismic retrofit configuration, the under-floor bearing insertion. But also the less frequent over-footing configuration.

The isolation space is usually surrounded by partitions which receive similar fire proofing assemblies for continuity. These assemblies are prefabricated or preassembled in segments and spliced in the field. Splicing is by metal cover plates.

At the opposite side of the flame side, the displaceable partition fire proofing assembly is supplied with an elastomeric curtain to pass the fire hose test. The curtain is wrapped back from under to drop water. Without these curtains the hot fire rating assemblies exploded in laboratory upon contact of cold pressurized water. The curtain is painted with flame retardant pigment. When the flame side is not designated curtains are provided on each side. Then one of the curtains may bum off without interfering fire rating functions.

The displaceable fire rating assembly for seismic isolators and isolation spaces separated by partitions address a recently emerged construction problem. It also addresses code challenges too. Early attempt with conventional sprayed asbestos assemblies without frictional surfaces failed in practice and in laboratory testings. Fully elastomeric assemblies failed similarly. The described assemblies passed the related stringent test requirement and proved to be practical in some built applications.

Configurations and details are not limited to the presented details and descriptions. The skilled in the field may combine elements shown or substitute components with equivalents or similar. For instance, the collar and box may be reversed without noticeable difference in performance. The collar up position is only practical because at friction the accumulated dust is automatically dropped, not entrapped. Also, the same section apply to a steel column or a concrete or masonry wall as to the concrete column presented here.

We claim:

1. A displaceable fire proofing assembly enclosing and accommodating relative movement between two or more ends of an enclosed isolation bearing comprising:

a first wall having a plurality of spaced apart stud members with first covering members on either side of said stud members, said first wall attached to a first location above said bearing, said first wall including a first rigid abutting surface on at least one of said first covering members, said first rigid abutting surface lined with a first heat reflective layer; and a second wall abutting said first wall, said second wall having a plurality of spaced apart stud members with second covering members on either side of said stud members, said second wall attached to a second location below said bearing, said second wall including a second rigid abutting surface on at least one of said second covering members, said second rigid abutting surface lined with a second heat reflecting layer for frictionally engaging said first rigid abutting surface.

2. The fire proofing assembly of claim 1, wherein said first heat reflective layer and said second heat reflective layer further includes at least one of a fire blanket and an intumescent material.

3. The fire proofing assembly of claim 1, wherein said assembly is prefabricable.

4. The fire proofing assembly of claim 1, wherein said assembly allows for periodic visual inspection of said isolation bearing.

5. The fire proofing assembly of claim 1, wherein said assembly is comprised of fire rated materials, said fire rated materials fire rate after at least one of small horizontal displacement, small compression and small uplift.

6. The fire proofing assembly of claim 1, wherein said assembly substantially restricts smoke and flame.

7. The fire proofing assembly of claim 1, wherein said assembly includes a curtain over said first and second abutting surfaces, whereby said curtain is configured to drop water.

8. The fire proofing assembly of claim 1, wherein said first and second abutting surfaces further include a spring, whereby said spring exerts a force against said first and second reflecting layers, respectively.

9. A method for enclosing and accommodating relative movement between two or more ends of an enclosed isolation bearing with a displaceable fire proofing assembly, wherein said method includes the steps of:

providing an isolation bearing:

providing a first wall having a plurality of spaced apart stud members with first covering members on either side of said stud members;

providing a first rigid abutting surface on one of said first covering members;

lining said first rigid abutting surface with a first heat reflective layer;

attaching said first wall to a first location above said bearing;

providing a second wall abutting said first wall, said second wall having a plurality of spaced apart stud members with second covering members on either side of said stud members;

providing a second rigid abutting surface on one of said second covering members;

lining said second rigid abutting surface with a second heat reflecting layer;

attaching said second wall to a second location below said bearing;

frictionally engaging said first rigid abutting surface against said second rigid abutting surface.

10. The method of claim 9, wherein said step of lining said first abutting surface and said second abutting surface further includes providing at least one of a fire blanket and an intumescent material under said first and second heat reflecting layer, respectively.

11. The method of claim 9, wherein said method includes providing a prefabricable assembly.

12. The method of claim 8, wherein said displaceable fire proof assembly is comprised of fire rated materials where said fire rated materials first rate after at least one of small horizontal displacement, small compression and small uplift.

13. The method of claim 9 further including the step of substantially restricting smoke and flame.

14. The method of claim 9 further including dropping water, wherein said assembly further includes providing a curtain over said first and second abutting surface, whereby said curtain is configured to drop water.

15. The method of claim 9, wherein said steps of providing said first and second abutting surfaces further include providing a spring, whereby said spring exerts a force against said first and second reflecting layers, respectively.

* * * * *